US011192269B2

(12) United States Patent
Aggelopoulou et al.

(10) Patent No.: US 11,192,269 B2
(45) Date of Patent: Dec. 7, 2021

(54) SYSTEM AND METHOD FOR ELECTRICALLY SENSING SHAVING RAZOR BLADE WEAR

(71) Applicant: Bic Violex S.A., Anoixi (GR)

(72) Inventors: Paraskevi Aggelopoulou, Athens (GR); Christos Galanis, Athens (GR); Georgios Goudelis, Athens (GR); Grigorious Gerasimos Koutsouridis, Salonika (GR); Alexandra Antonakou, Athens (GR); Stavroula Kaloskami, Athens (GR); Georgios Katranas, Athens (GR); Charalampos Schizas, Athens (GR)

(73) Assignee: Bic Violex S.A., Anoixi (GR)

( * ) Notice: Subject to any disclaimer, the term of this patent is extended or adjusted under 35 U.S.C. 154(b) by 0 days.

(21) Appl. No.: 16/622,526

(22) PCT Filed: Jun. 1, 2018

(86) PCT No.: PCT/EP2018/064417
§ 371 (c)(1),
(2) Date: Dec. 13, 2019

(87) PCT Pub. No.: WO2019/001891
PCT Pub. Date: Jan. 3, 2019

(65) Prior Publication Data

US 2020/0206963 A1 Jul. 2, 2020

Related U.S. Application Data

(60) Provisional application No. 62/526,774, filed on Jun. 29, 2017.

(51) Int. Cl.
*B26B 21/40* (2006.01)
*B26B 21/52* (2006.01)

(52) U.S. Cl.
CPC ..... *B26B 21/4087* (2013.01); *B26B 21/4056* (2013.01); *B26B 21/526* (2013.01)

(58) Field of Classification Search
CPC ..... B26B 21/4087; B26B 21/526; B26B 21/4056; G01B 7/18; G01B 7/20; G01N 3/58; B23Q 17/09–0995
See application file for complete search history.

(56) References Cited

U.S. PATENT DOCUMENTS 5,388,331 A 2/1995 Siamak
6,009,623 A * 1/2000 Orloff ..... B26B 21/4056 30/41.7

(Continued)

FOREIGN PATENT DOCUMENTS

CN 101801620 A 8/2010
CN 104166369 A 11/2014

(Continued)

OTHER PUBLICATIONS

International Search Report and Written Opinion issued in International Application No. PCT/EP2018/064417, dated Aug. 20, 2018 (9 pages).

(Continued)

*Primary Examiner* — Evan H Macfarlane
(74) *Attorney, Agent, or Firm* — Bookoff McAndrews, PLLC

(57) ABSTRACT

A system and method for determining a level of wear of at least one blade of a razor cartridge, which includes a sensing unit measures an electrical parameter including one of (i) a total resistance of the at least one blade measured across a length of the at least one blade, and (ii) an electrical conductance of the at least one blade measured across the length of the at least one blade. A processing unit compares the measured electrical parameter to a reference electrical parameter and determines a level of wear of the at least one (Continued)

blade based on an amount of deviation of the measured electrical parameter from the reference electrical parameter. Information regarding the determined level of wear of the at least one blade is provided to a user by at least one of (i) a light indication, (ii) an aural indication, and (iii) a haptic indication.

20 Claims, 13 Drawing Sheets

(56) References Cited

U.S. PATENT DOCUMENTS 6,456,054 B1 * 9/2002 Kataoka ..... B23Q 17/0928 324/71.2
6,556,925 B1 * 4/2003 Mori ..... B23B 27/145 702/34
6,817,101 B1 * 11/2004 Bohmer ..... B26B 21/48 30/140
6,836,966 B2 * 1/2005 Patrick ..... B26B 19/382 30/140
7,100,283 B1 * 9/2006 Grdodian ..... B26B 21/4056 30/34.05
8,037,608 B2 * 10/2011 Schnak ..... B26B 21/38 30/45
8,122,606 B2 * 2/2012 Hart ..... B26B 21/4056 30/41.7
8,230,600 B2 * 7/2012 Hart ..... B26B 21/4056 30/41.7
8,479,624 B2 * 7/2013 Flyash ..... A61B 18/082 83/13
8,533,958 B2 * 9/2013 Tomassetti ..... A45D 27/29 30/34.05
9,126,346 B2 * 9/2015 Meier ..... A61C 17/221
9,604,375 B2 * 3/2017 Bohmer ..... B26B 21/48
10,589,437 B2 * 3/2020 Amavasai ..... B26B 21/4056
10,598,579 B2 * 3/2020 Kalhori ..... B23Q 17/0952
10,647,011 B2 * 5/2020 Robinson ..... B26B 21/4081
2004/0098862 A1 * 5/2004 Orloff ..... B26B 21/521 30/41.7
2006/0070242 A1 * 4/2006 Szczepanowski ..... B26B 21/48 30/140
2007/0050982 A1 3/2007 Freund et al.
2008/0052911 A1 * 3/2008 Kohler ..... B26B 21/4056 30/41.7
2009/0056141 A1 * 3/2009 Barry ..... B26B 21/40 30/41.7
2017/0099199 A1 * 4/2017 Bauer ..... H04L 67/22

FOREIGN PATENT DOCUMENTS

EP 0945229 A1 9/1999
WO WO 2011/070486 A1 6/2011

OTHER PUBLICATIONS

Chinese search report in Chinese Application No. 201880031866.5, dated Jan. 26, 2021 (1 page).

* cited by examiner

SYSTEM AND METHOD FOR ELECTRICALLY SENSING SHAVING RAZOR BLADE WEAR

CROSS REFERENCE TO RELATED APPLICATIONS

This application is the U.S. National Stage Application under 35 U.S.C. § 371 of International Application No. PCT/EP2018/064417, filed on Jun. 1, 2018, now published as WO2019001891, which claims the benefit under 35 U.S.C. § 119(e) of U.S. Provisional Patent Application Ser. No. 62/526,774, entitled "System and Method for Electrically Sensing Shaving Razor Blade Wear," filed on Jun. 29, 2017.

BACKGROUND OF THE DISCLOSURE

1. Field of the Disclosure

The present disclosure relates to a shaving razor having one or more blades. More particularly, the present disclosure relates to a system and method for electrically sensing the wear of one or more blades of the shaving razor.

2. Description of the Related Art

A user of a shaving razor is faced with the problem of determining the optimum time for replacing a shaving cartridge or a shaving razor blade. However, it is not feasible for a user to objectively determine precise level(s) of wear of the cartridge and/or the blade. Thus, the user needs to rely on a subjective feeling of how effective the cartridge and/or the blade is for shaving. On the one hand, it is not cost-effective to replace the cartridge and/or the blade too soon, i.e., before the razor and/or the blade is actually worn and has lost a significant amount of shaving effectiveness. On the other hand, waiting too long to replace the cartridge and/or the blade will result in poor shaving experiences, e.g., cuts and remaining stubbles. Therefore, there is a need for a system and a method for at least (i) objectively determining precise level(s) of wear of the cartridge and/or the blade, and (ii) notifying a user when to replace the cartridge and/or the blade, which system and method eliminate the guesswork now required.

SUMMARY

The present disclosure provides a system and a method to objectively determine one or more level(s) of wear of a shaving cartridge and/or a shaving blade of the shaving cartridge.

The present disclosure also provides a system and a method to objectively determine one or more level(s) of wear of a shaving cartridge and/or a shaving blade of the shaving cartridge by measuring electrical resistance and/or electrical conductance of the cartridge and/or the blade using a sensing system.

The present disclosure further provides a system and a method to objectively determine one or more level(s) of wear of a shaving cartridge and/or a shaving blade of the shaving cartridge by measuring electrical resistance and/or electrical conductance of the cartridge and/or the blade using a sensing system provided in or on the shaving cartridge and/or a handle of the shaving razor.

The present disclosure still further provides a system and a method to objectively determine one or more level(s) of wear of a shaving cartridge and/or a shaving blade of the shaving cartridge by measuring electrical resistance and/or electrical conductance of the cartridge and/or the blade using a sensing system provided in or on a base unit or module that is distinct from the shaving cartridge and/or a handle of the shaving razor.

The present disclosure yet further provides a system and a method to objectively determine one or more level(s) of wear of a shaving cartridge and/or a shaving blade of the shaving cartridge and notify a user of the cartridge regarding the determined level(s) of wear of the shaving cartridge and/or the shaving blade of the shaving cartridge.

The present disclosure also provides a shaving cartridge having at least one blade that has at least a substrate, a coating of a conductive layer on the substrate, and a coating of an insulation layer on the conductive layer, which blade can be used in conjunction with a sensor configured to measure electrical resistance and/or electrical conductance of the cartridge and/or the blade to objectively determine one or more level(s) of wear of the shaving cartridge and/or the blade.

The present disclosure further provides a notification unit comprising at least one of (i) a light indication unit configured to output information regarding the determined level of wear of the at least one blade and/or the cartridge, (ii) an aural indication unit configured to output information regarding the determined level of wear of the at least one blade and/or the cartridge, and (iii) a haptic indication unit configured to output information regarding the determined level of wear of the at least one blade and/or the cartridge. In this manner, the user will objectively know the level of wear of the at least one blade and/or the cartridge.

The present disclosure still further provides a notification unit comprising at least one of (i) a light indication unit configured to output information regarding when to replace the at least one blade and/or the cartridge, (ii) an aural indication unit configured to output information when to replace the at least one blade and/or the cartridge, and (iii) a haptic indication unit configured to output information regarding when to replace the at least one blade and/or the cartridge. In this manner, the user will objectively know when to order and/or replace shaving cartridges.

The present disclosure yet further provides a proximity sensor to determine whether a shaving cartridge and/or at least one blade of the cartridge is in contact with a user's facial and/or body skin and/or water.

The present disclosure also provides a proximity sensor to determine whether a shaving cartridge and/or at least one blade of the cartridge is in contact with a user's facial and/or body skin and/or water, so that it can be determined whether the total resistance being measured across the length of a shaving cartridge and/or at least one blade of the cartridge is affected by the resistance of the user's skin and/or water in contact with exposed conductive layer of the blade.

The present disclosure in addition provides a system and a method to objectively determine one or more level(s) of wear of a shaving cartridge and/or a shaving blade of the shaving cartridge so that information regarding the determined level of wear of the blade can be cumulatively collected, stored, and/or analyzed by a control and/or analysis unit to determine the rate of wear of the shaving cartridge and/or the shaving blade of the shaving cartridge.

BRIEF DESCRIPTION OF THE DRAWINGS

A component or a feature that is common to more than one drawing is indicated with the same reference number in each of the drawings.

DETAILED DESCRIPTION OF THE DISCLOSURE

Figure 1:
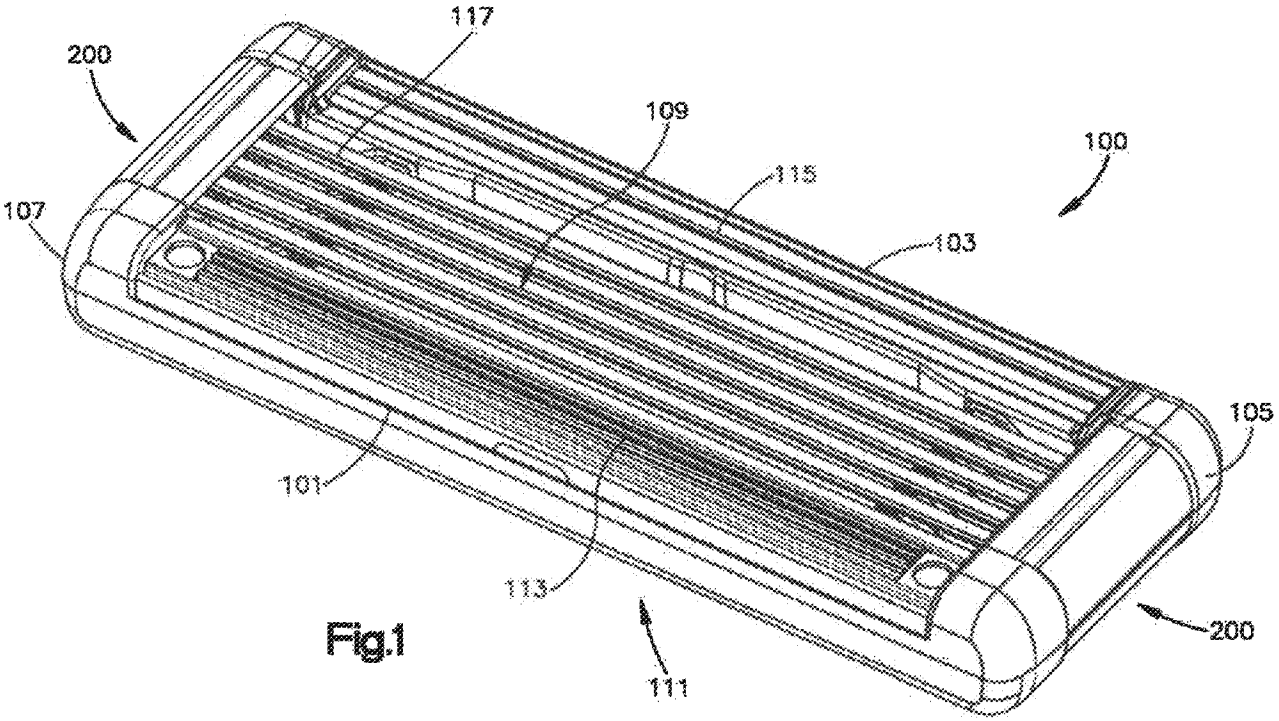
FIG. 1 is a perspective view of an example of a shaving cartridge including retainers for securing blades to the cartridge.

Referring to the drawings and, in particular, to FIG. 1 there is a shaving cartridge generally represented by reference numeral 100. Shaving cartridge 100 includes retainers 200 for securing blades 117 to cartridge 100. Shaving cartridge 100 includes a housing having a front edge 101, a rear edge 103, a pair of side edges 105, 107, a top surface 109 and a bottom surface 111. The pair of side edges 105, 107 extend between front edge 101 and rear edge 103 of the housing. The shaving cartridge 100 includes a guard bar 113 adjacent to front edge 101 of the housing and a cap 115 adjacent to rear edge 103 of the housing. A lubricating element can be provided on the surface of cap 15. One or more blades 117 are positioned between guard bar 113 and cap 115 and retained in position in the housing using one or more retaining element(s), e.g., a pair of retainers 200 positioned in the housing.

Although shaving cartridge 100 shown in FIG. 1 includes five blades 117 retained in position in the housing using a pair of retainers 200, any number of blades can be used and any number and/or type of retaining element(s), e.g., one or more retaining clips, can be provided at suitable location(s) to retain the blade(s) in position.

Figure 2:
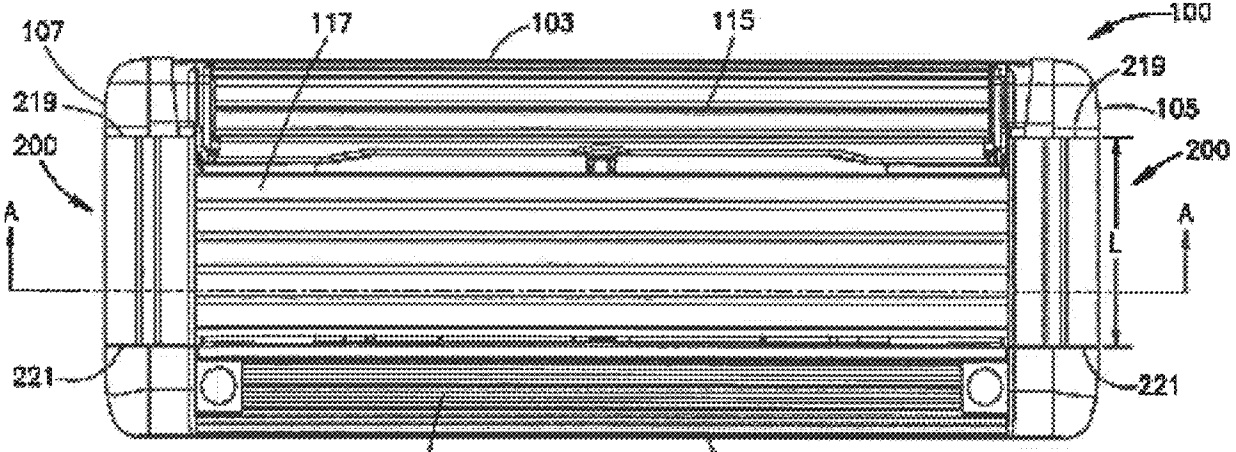
FIG. 2 is a top view of the shaving cartridge including the retainers.
Figure 3:
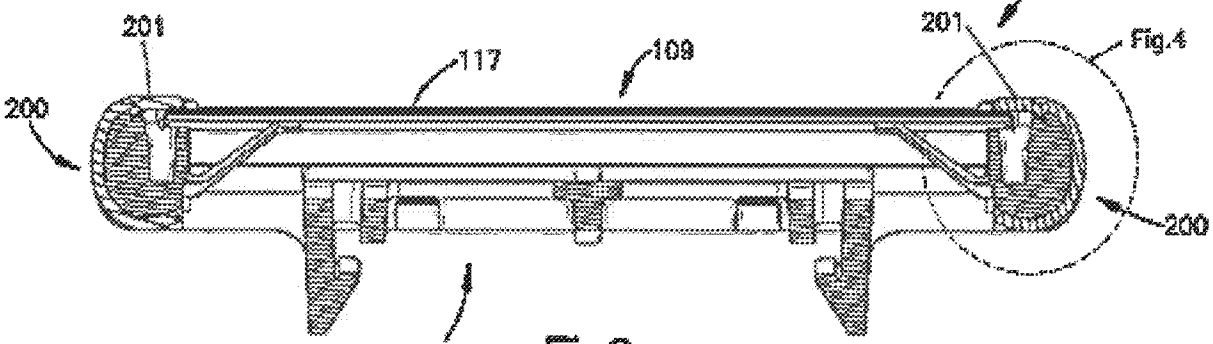
FIG. 3 is a cross-sectional view of the shaving cartridge along line A-A in FIG. 2.

Referring to FIGS. 2-3, retainers 200 are spaced apart and positioned on opposite sides of the housing. Retainers 200 extend alongside edges 105 and 107 of the housing and include a top portion 201 that extends above top surface 109 of the housing and above one or more blades 117 to retain the position of blades 117 in the housing. Retainers 200 can be made of metal, and retainers 200 physically contact blades 117, so retainers 200 and one or more of the blades form an electrical path.

In this example, retainers 200 extend along a length L on side edges 105 and 107 of about 8.5 mm. However, it should be appreciated that retainers 200 can extend along a shorter or longer portion of the side edges 105 and 107. For example, a pair of retainers 200 may each extend along the entire length, a shorter portion, or a longer portion of side edges 105 and 107. Such extensions can secure in place a guard bar, a cap element, or a trimmer assembly, for example. In addition, as noted above, any number of retainers can be used with shaving cartridge 100. For example, a single retainer or four retainers can be used to retain the position of the blades 117 in the housing. Retainers 200 each may include a front edge 221 and a rear edge 219.

Figure 4B:
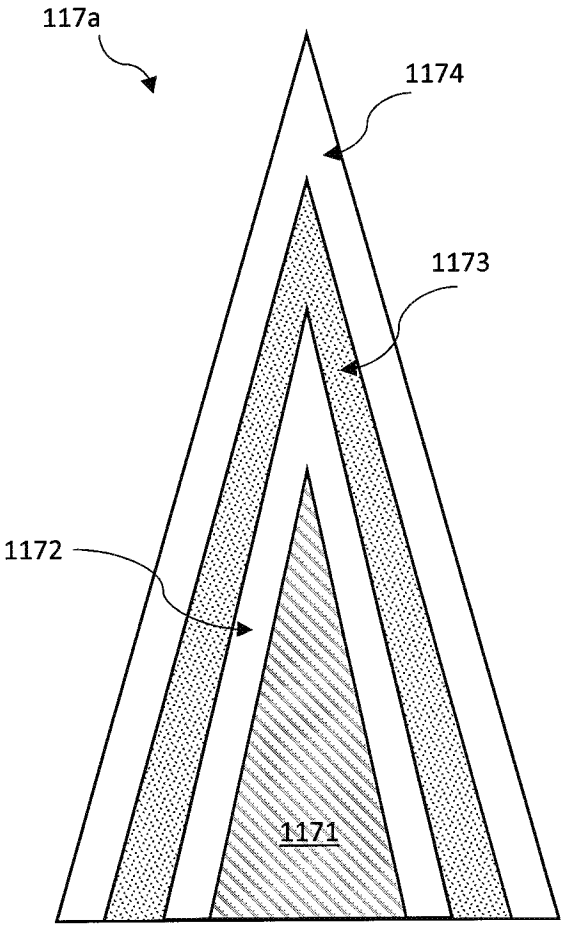
FIG. 4*b* is a schematic view of the various layers of the blade edge region.
Figure 4A:
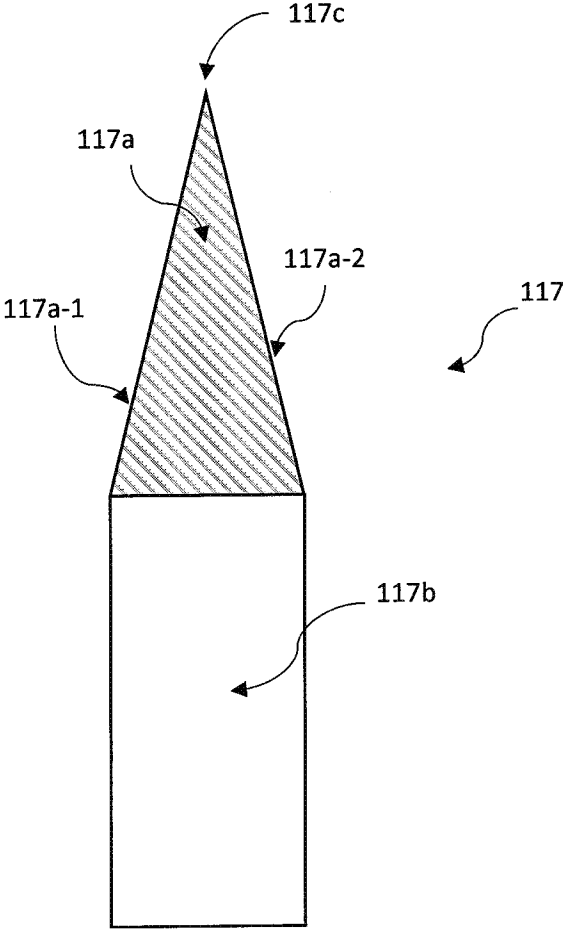
FIG. 4*a* is a schematic view of a razor blade having a blade edge region and a blade body.

Referring to FIG. 4*a*, a blade 117 has a blade edge region 117*a* and a blade body 117*b*. Blade edge region 117*a* has two sides 117*a*-1 and 117*a*-2 that meet at a tip 117*c*. An example embodiment of blade 117 includes a substrate, e.g., stainless steel substrate, on which substrate various layers of coating can be applied, as explained below in more detail in connection with FIG. 4*b*.

According to the embodiment shown in FIG. 4*b*, blade edge region 117*a* has at least two distinct layers of coating on the stainless-steel substrate 1171. In the case where blade edge region 117*a* has two distinct layers, the first layer (or lower layer) 1172 can be made of materials that provide hardness and corrosion resistance such as chromium (Cr) and/or chromium carbon (CrC). Second layer (upper layer) 1173 can be made of a polymeric material such as a fluoropolymer (e.g., polytetrafluoroethylene telomer, also referred to as PTFE) or other materials providing hardness, insulation and lubriciousness. Second layer (upper layer) 1173 may be referred to as an insulation layer, for the sake of brevity. In the case where blade edge region 117*a* has three distinct layers of coatings on the stainless-steel substrate 1171 the first layer (or lower layer) 1172 is provided on substrate 1171. First layer 1172 can be made of materials that provide hardness and corrosion resistance, such as ceramics. First layer (lower layer) 1172 can be made of other materials including at least one of nitrides, oxides, borides, and carbides, which examples are not limiting. A second layer (or middle layer) 1173 is provided on first layer 1172. Second layer 1173 can be made of conductive materials including at least one of graphene, gallium nitride (GaN) and aluminum nitride (AlN), for example. Second layer (middle layer) 1173 can be made of other materials, and the specific examples provided herein are not limiting. A third layer (or upper layer) 1174 is provided on second layer 1173. Third layer 1174 can be made of a polymeric material such as a fluoropolymer (e.g., polytetrafluoroethylene telomer, also referred to as PTFE) or other materials providing hardness, insulation and lubriciousness. Third layer 1174 may be referred to as an insulation layer, for the sake of brevity. The specific examples provided herein are not limiting. In addition, only blade edge region 117*a* is shown with the coating layers 1172-1174, the entire blade 117 can be coated with the coating layers 1172-1174.

When the shaving cartridge 100 having at least one blade 117 is used for shaving, blade edge region 117*a* is subjected to wear, e.g., breaks, incontinuities, loss of one or more of the coating layers 1172-1174. According to the present disclosure, systems and methods are provided herein to advantageously implement (i) objective determination of multiple levels of wear of blade edge region 117*a* and/or blade 117, (ii) provide notifications to the user regarding the multiple levels of wear, and (iii) provide notifications to the user when to change shaving cartridge 100 and/or blade 117. The level of wear can be determined in several ways.

In one method, the increase of wear (e.g., breakages that result in loss of conductive material) on blade edge region 117*a* will result in decreased electrical conductance for blade 117 in comparison to a new blade having a specified reference electrical conductance. The electrical conductance of blade 117 can be measured to determine the level of wear of blade 117 based on the relative deviation of the measured electrical conductance of blade 117*a* from the specified electrical conductance.

In another embodiment, an electrical conductance sensor, e.g., located in or on shaving cartridge 100, can be utilized for this purpose. In addition, other locations and/or arrangements for the electrical conductance sensor can be implemented. For example, the electrical conductance sensor can be located in or on a handle of a shaver, to which shaving cartridge 100 is attached, or the electrical conductance sensor can be provided in or on a base unit separate from the shaver. In an example embodiment, the base unit can have a conductive contact surface, and the electrical conductance measurement can be implemented by contacting the length of blade 117 with the conductive contact surface. In another embodiment, an electrical conductance sensor provided in the base unit can be utilized to perform the electrical conductance measurement. In another embodiment, razor blade 117 can be electrically coupled to the base station. For each of these exemplary embodiments, the measured electrical conductance and/or the determined level of wear of blade 117 can be transmitted (e.g., via a wired or wireless connection) to, and/or stored in, the based unit. The embodiments, however, are not limited to these examples. Although the above examples have been described in the context of measuring electrical conductance for one blade of the razor, the electrical conductance measurement can be performed separately for multiple blades of the cartridge, or performed together to provide a measurement for the cartridge as a whole.

Another example method for detecting the wear on blade 117 use detection of overall resistance (or detection of the inverse quantity, i.e., electrical conductance) measured across the length of blade 117. When third layer (or upper layer) 1174 made of, e.g., PTFE, degrades due to use of shaving cartridge 100 having at least one blade 117, conductive layer (middle layer or lower layer in case of two layers in total) 1173 becomes exposed and comes in contact with water and/or shaving aid and/or skin and/or hair during shaving, which will result in reduced total resistance (or increased electrical conductance, which is the inverse quantity) in comparison to a new blade having a specified reference electrical conductance measured across the length of blade 117, as will be explained in detail in connection with FIGS. 5*a*-5*c*.

In another embodiment, an electrical resistivity sensor, e.g., located in or on shaving cartridge 100, can be utilized for this purpose. In addition, other locations and/or arrangements for the electrical resistivity sensor can be implemented. For example, the electrical resistivity sensor can be located in or on a handle of a shaver, to which shaving cartridge 100 is attached, or the electrical resistivity sensor can be provided in or on a base unit separate from the shaver. In another embodiment, the base unit can have a resistive contact surface, and the resistance measurement can be implemented by contacting the length of blade 117 with the resistive contact surface and measuring the total resistance across the length of blade 117, e.g., by a resistivity sensor. In another embodiment, the razor blade can be electrically coupled to the base station. For each of these exemplary embodiments, the measured resistance and/or the determined level of wear of blade 117 can be stored in a storage element in the cartridge 100 or the handle, and/or transmitted (e.g., via a wired or wireless connection) to, and/or stored in, the base unit. The embodiments, however, are not limited to these examples. Although the above examples have been described in the context of measuring the total resistance for one blade of the razor, the resistance measurement can be performed separately for multiple blades of the cartridge, or performed together to provide a measurement for the cartridge as a whole.

Figure 5C:
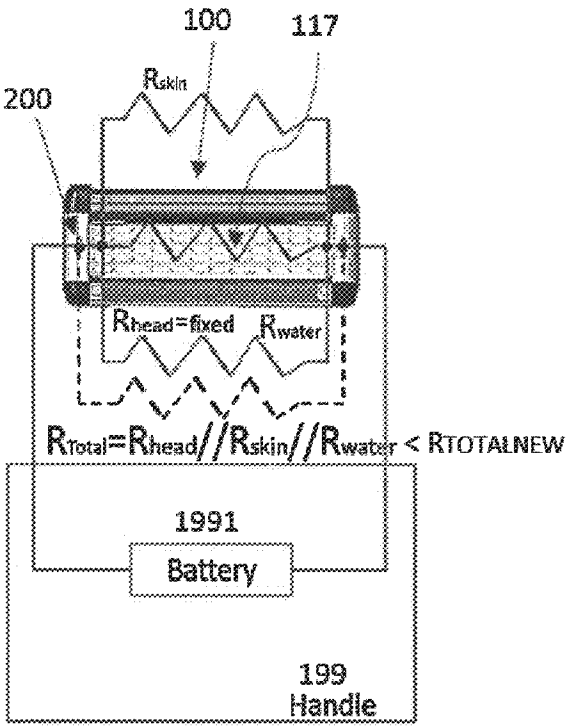
FIGS. 5*a*-5*c* are schematic illustrations of the total resistance measured across the length of the blade(s) of the razor cartridge for various conditions.

As described in connection with FIGS. 1-3, blade 117 is retained in place in cartridge 100 by a pair of retainers 200. A new cartridge with a new blade 117 (which has a full insulation coating formed by third layer or upper layer 1174 made of, e.g., PTFE) will have one of (i) a specified reference total resistance, $R_{TOTAL}=R_{head}=R_{TOTALNEW}$ measured across a length of the at least one blade, and (ii) a specified reference electrical conductance (i.e., the inverse of the resistance) of the at least one blade measured across a length of the at least one blade, as shown in FIG. 5*a*, which depicts a closed circuit having a battery 1991, the pair of retainers 200, and blade 117 in contact with the retainers 200. Although multiple blades are shown within the cartridge in the example of FIG. 5*a*, the number of blades can be one or more. For multiple blades provided in cartridge 100, one or all of the blades 117 can be electrically connected with retainers 200, depending on the desired measurement.

When the insulation coating formed by third layer or upper layer 1174 made of, e.g., PTFE, at blade edge region 117*a* shown in FIG. 4*b* wears away due to repeated friction with skin and hair, conductive layer (middle layer or lower layer in case of two layers in total) 1173 becomes exposed and comes in contact with water and/or shaving aid and/or skin and/or hair during shaving, which creates parallel resistance path(s) across the length of blade 117, which in turn will result in reduced total resistance (or increased electrical conductance, which is the inverse quantity) measured across the length of blade 117 (e.g., between the two retainers 200) in comparison to a new blade having the specified reference total resistance $R_{TOTALNEW}$ measured across a length of the at least one blade 117. The measurement of the resistance (or electrical conductance) can be performed (i) separately for one or more individual blade(s), (ii) for the entire cartridge at one time, or (iii) for a subgroup of blades provided in the cartridge.

Figure 5B:
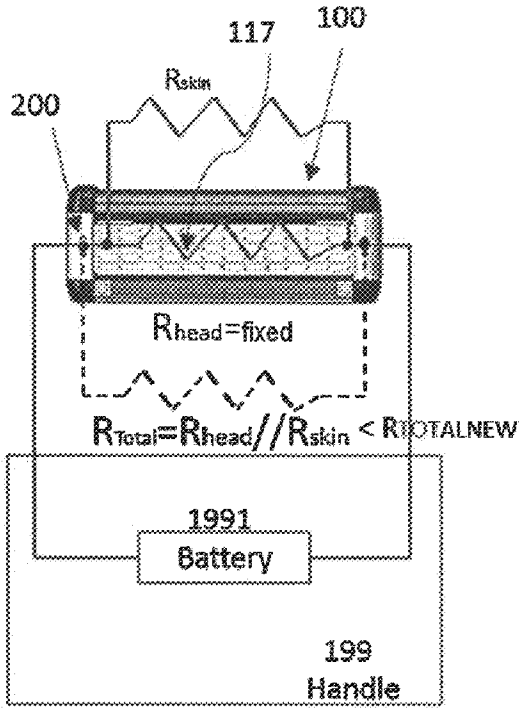
Figure 5A:
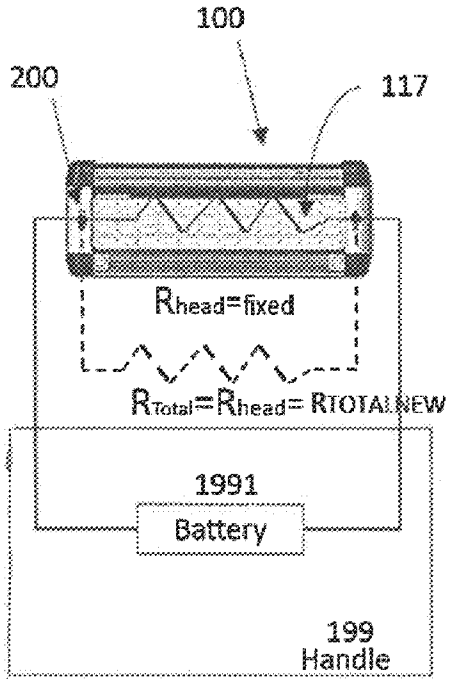

FIG. 5*b* depicts the equivalent circuit for the case in which conductive layer (middle layer or lower layer in case of two layers in total) 1173 becomes exposed and comes in contact with skin, thereby creating a parallel resistance path $R_{skin}$. As is well known from basic electric circuit theory, when two or more resistances are connected in parallel, the total resistance of the circuit is lower than the lowest individual resistance in the parallel circuit. Therefore, the total resistance, $R_{TOTAL}=R_{head}/R_{skin}$, measured across the length of the at least one blade 117 (e.g., between the two retainers 200), will be lower than the specified reference total resistance $R_{TOTALNEW}$.

FIG. 5*c* depicts the equivalent circuit for the case in which conductive layer (middle layer or lower layer in case of two layers in total) 1173 of blade edge region 117*a* becomes exposed and comes in contact with skin and water while shaving, thereby creating parallel resistance and/or conductive paths/branches $R_{skin}$ and $R_{water}$. Therefore, the total resistance, $R_{TOTAL}=R_{head}/R_{skin}/R_{water}$, measured across the length of the at least one blade 117 (e.g., between the two retainers 200), will be lower than the specified reference total resistance $R_{TOTALNEW}$.

Therefore, in the case a total resistance lower than the reference resistance is detected, it can be concluded that (i) the insulating material of third layer or upper layer 1174 made of, e.g., PTFE, has worn away (at least in some parts), and (ii) cartridge 100 and/or blade 117 may need replacing. The same applies in the case where the blade edge demonstrates significant wear (e.g., breakages that result in loss of conductive material). For example, if one assumes that a new blade 117 of approximately 4.1 cm length has a reference (initial) resistance of 1Ω (i.e., when the blade fully insulated and new), then a used blade with worn third layer or upper layer 1174 or exhibiting breakages that result in loss of material, will exhibit a resistance lower than 1Ω. In an example embodiment, multiple threshold values could be utilized to determine multiple levels of wear of blade 117 and/or cartridge 100, which levels of wear may be indicated as outputs, e.g., visual and/or light indication, aural indication, and/or haptic indication, which examples are not limiting. For example, if the total circuit resistance is between 0.9-1Ω, a green light (e.g., LED) will be turned on to indicate that blade 117 is relatively new and/or in good condition. If the total circuit resistance is between 0.5-0.9Ω, an orange light (e.g., LED) will be turned on to indicate that blade 117 is somewhat worn and/or used. Finally, if the total circuit resistance is below 0.5Ω, a red light (e.g., LED) will be turned on to indicate that blade 117 is badly worn (i.e., most of the insulating third layer or upper layer 1174 has worn off) and blade 117 and/or cartridge 100 needs replacing.

In another embodiment, a proximity sensor can be provided to augment the resistivity sensor and/or the electrical conductance sensor, such that it can be determined whether the total circuit resistance being measured is affected by the resistance of the user's skin, hair and/or shaving aid and/or water, e.g., when blade 117 has lost at least some of insulating third layer or upper layer 1174 and has come in contact with the user's skin and/or water.

Figure 6A:
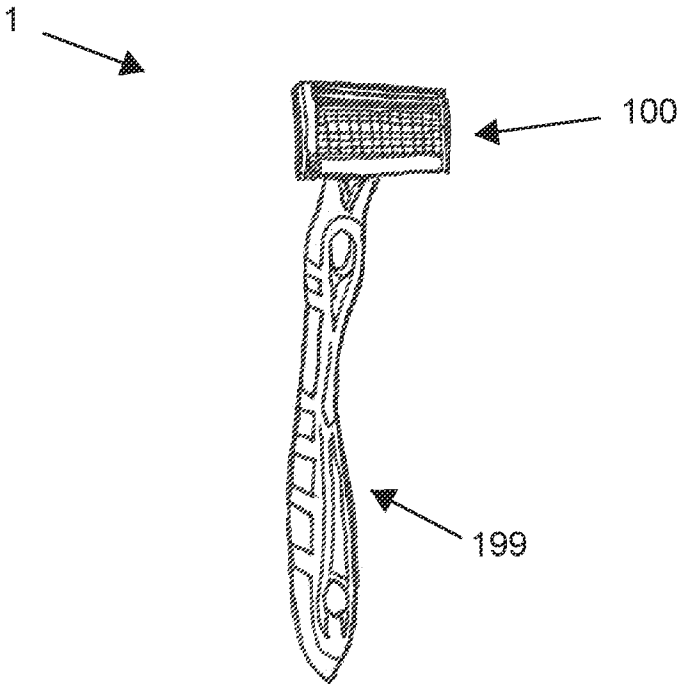
FIG. 6*a* is a perspective view of a razor having a handle and a cartridge.

FIG. 6*a* is an example razor 1 having a handle 199 and a cartridge 100. In an example embodiment, various components (including electric and/or electronic components) and circuitry can be provided in or on the razor to implement various aspects of the present disclosure, as shown in FIGS. 6*b* and 6*c*.

Figure 6B:
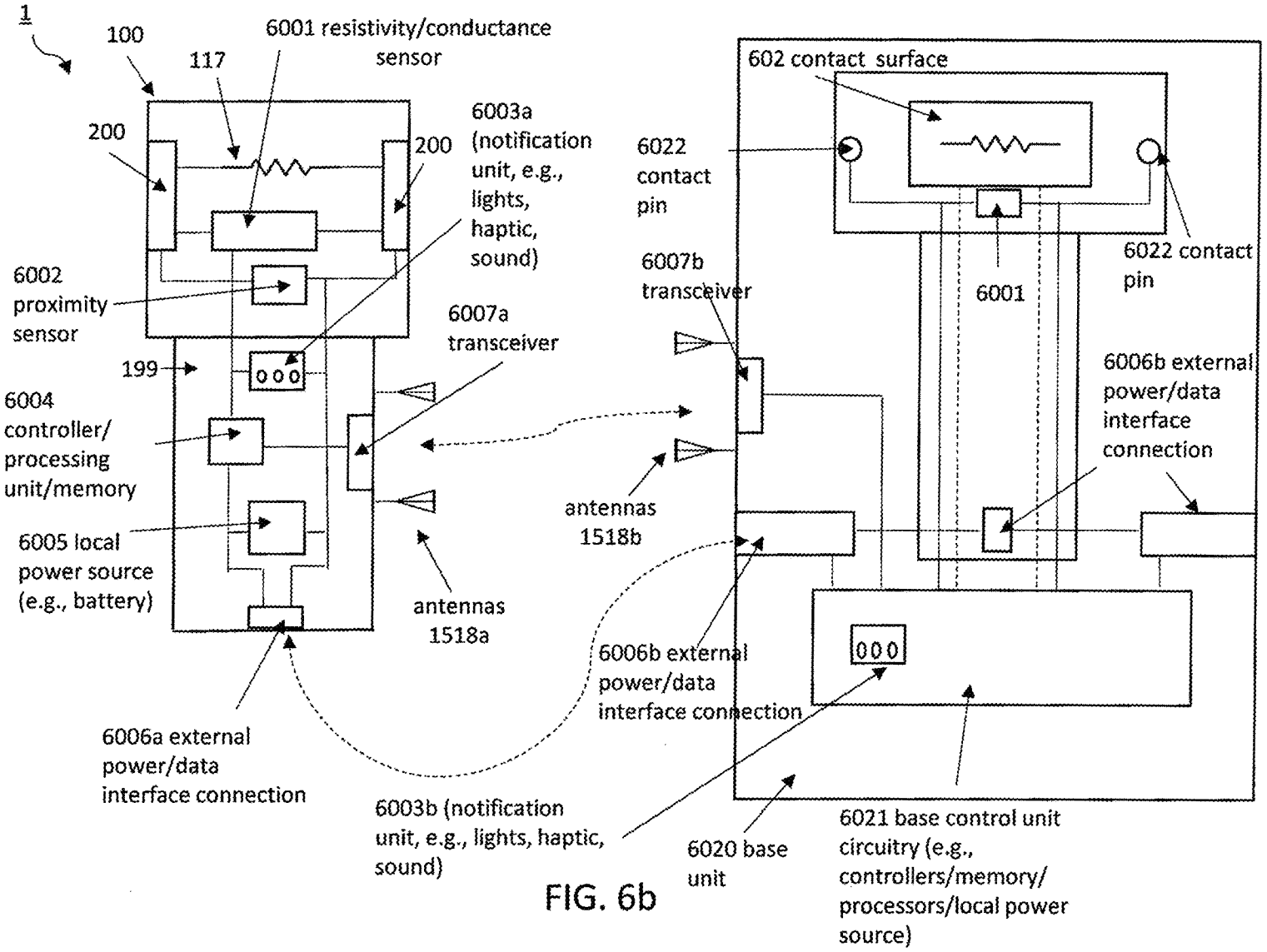
FIG. 6*b* is a schematic showing various electric/electronic components of a razor and an external base module, as well as communication paths between the razor and the base module, according to an embodiment of the present disclosure.
Figure 6C:
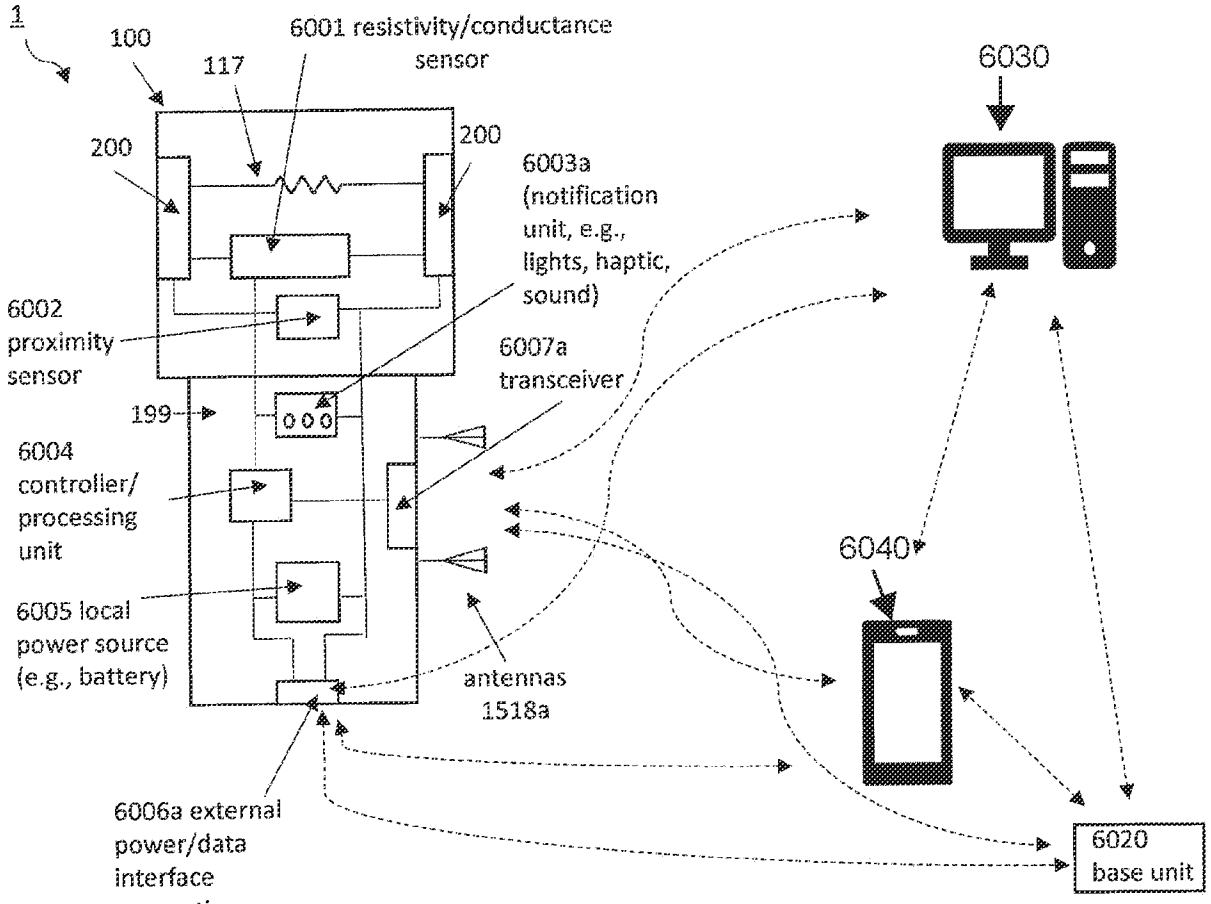
FIG. 6*c* is a schematic showing various electric/electronic components of a razor, as well as communication paths between the razor and external devices, according to another embodiment.

FIG. 6*b* illustrates various examples of (i) electric and/or electronic components of a razor 1 (shown on the left side of FIG. 6*b*) having a cartridge 100 and a handle 199, (ii) electric and/or electronic components of an external base module or unit 6020 (shown on the right side of FIG. 6*b*), and (iii) various connection and communication paths between razor 1 and base module or unit 6020, according to an example embodiment.

The razor 1 schematically illustrated in FIG. 6*b* includes the following example components, which are electrically and/or communicatively connected: a sensor 6001, which can be a resistivity sensor and/or an electrical conductance sensor; a proximity sensor 6002; a notification unit 6003*a*, which can be configured to generate a visual (e.g., lights), haptic and/or sound notification; a control unit 6004, which can be configured to include a controller, a processing unit and/or a memory; a local power source 6005 (e.g., battery); an interface unit 6006*a*, which can be configured as an interface for external power connection and/or external data connection; a transceiver unit 6007*a* for wireless communication; and antennas 1518*a*. The sensor 6001 is configured to measure, e.g., during shaving, the total resistance (and/or the electrical conductance) across blade 117, e.g., from first retainer 200 on the left side to second retainer 200 on the right side. As mentioned above, if conductive second layer (middle layer or lower layer in case of two layers in total) 1173 (shown in FIG. 4*b*) of blade 117 becomes exposed and comes in contact with water and/or skin and/or hair and/or shaving aid during shaving, parallel resistance path(s) across the length of blade 117 will be present, which in turn will result in reduced total resistance (or increased electrical conductance) measured across the length of blade 117 (e.g., between the two retainers 200) in comparison to a new blade having the specified reference total resistance $R_{TOTALNEW}$. In addition, proximity sensor 6002 can be used to determine whether the total resistance being measured is affected by the resistance of the user's skin and/or water in contact with the exposed conductive second layer (middle layer or lower layer in case of two layers in total) 1173 of blade 117. For example, possible contact with the user's skin can be determined based on the detected distance (e.g., greater or lesser than a predefined threshold) of at least one blade of a razor cartridge relative to facial and/or body skin surface of a user of the razor cartridge. If the detected distance indicates no contact between the blade and the facial and/or body skin, it may be concluded that the deviation between the total resistance being measured and the specified reference total resistance is attributable to other external factor(s), e.g., presence of water.

The control unit 6004 receives and processes the information output from sensor 6001 and proximity sensor 6002 to determine the level of wear of blade 117. For example, control unit 6004 compares the measured electrical parameter, e.g., the measured total resistance (or the electrical conductance) across the length of blade 117, with a reference electrical parameter, e.g., (i) a specified reference total resistance measured across the length of a new blade (e.g., $R_{TOTALNEW}$ shown in FIG. 5*a*), or (ii) a specified reference electrical conductance of the blade measured across the length of the new blade. Control unit 6004 determines the level of wear of the blade 117 based on an amount of deviation of the measured electrical parameter from the reference electrical parameter. Control unit 6004 can provide information regarding the determined level of wear of blade 117 to notification unit 6003*a*, which in turn can generate an output signal corresponding to the determined level of wear by at least one of (i) a light indication (e.g., three different colored LED lights corresponding to different levels of wear, as described above), (ii) an aural indication, and/or (iii) a haptic indication.

Control unit 6004 can cumulatively collect and/or store the information regarding the determined level of wear of the blade to analyze and determine the rate of wear of blade 117, i.e., how fast a given user wears out a blade and/or a cartridge to determine whether a replacement is required. In addition, control unit 6004 can analyze the rate of wear of blade 117 in conjunction with data provided by a user or data from a database regarding particular skin properties and/or hair properties, thereby enabling customized analysis and data collection of an individual user's razor use.

The information output from sensor 6001 and proximity sensor 6002, and/or the information regarding the determined level of wear of the blade, can be transmitted (i) wirelessly via transceiver 6007*a* or (ii) via a wired connection through interface unit 6006*a* for external power/data connection, to base module or unit 6020, which is external to razor 1. As shown in FIG. 6*b*, base module or unit 6020 includes, for example, the following components: base control unit circuitry 6021, which can include processing unit(s), memory, processors, and a local power source (e.g., battery); sensor 6001, which can be a resistivity sensor and/or electrical conductance sensor as described above in connection with razor 1; a notification unit 6003*b*, which can be configured to generate a visual (e.g., three different colored LED lights corresponding to different levels of wear, as described above), haptic and/or sound notification; one or more interface unit(s) 6006*b*, which can be configured as an interface for external power connection and/or external data connection; a transceiver unit 6007*b* for wireless communication; a contact surface 602; two contact pins 6022; and antennas 1518*b*.

Base module or unit 6020 can be used in conjunction with razor 1 in multiple ways. In a first example, information received (e.g., via a hard-wired connection through interface 6006*b* or wirelessly via transceiver 6007*b*) from razor 1 (e.g., information output from sensor 6001 and proximity sensor 6002, and/or the information regarding the determined level of wear of the blade) can be used, e.g., by base control unit circuitry 6021, to indicate the determined level of wear of the blade by an output via notification unit 6003*b*.

In a second example, information received (e.g., via a hard-wired connection through interface 6006*b* or wirelessly via transceiver 6007*b*) from razor 1 (e.g., information output from sensor 6001 and proximity sensor 6002, and/or the information regarding the determined level of wear of the blade) can be cumulatively collected, stored, and/or analyzed by base control unit circuitry 6021 of base module or unit 6020 to determine the rate of wear of blade 117, i.e., how fast a given user wears out a blade and/or a cartridge so as to require a replacement. In addition, base control unit circuitry 6021 of base module or unit 6020 can analyze the rate of wear of blade 117 in conjunction with data provided by a user or data from a database regarding particular skin properties and/or hair properties, thereby enabling customized analysis and data collection of an individual user's razor use.

In a third example, base module or unit 6020 can be used to make the resistance and/or conductance measurement directly, instead of the resistance and/or conductance measurement being implemented by the components of razor 1. For the direct measurement by base module or unit 6020, (i) blade 117 of cartridge 100 is placed in contact with contact surface 602 of base module or unit 6020, which contact surface 602 can be a resistive contact surface and/or a conductive contact surface, and (ii) retainers 200 of cartridge 100 are placed in electrical contact with contact pins 6022 of based unit or module 6020. Sensor 6001 of base module or unit 6020 measures the total circuit resistance (and/or the electrical conductance) across blade 117, e.g., from first contact pin 6022 on the left side to second contact pin 6022 on the right side. If conductive second layer (middle layer or lower layer in case of two layers in total) 1173 (shown in FIG. 4*b*) of blade 117 becomes exposed and comes in contact with contact surface 602, parallel resistance path across the length of blade 117 will be present, which in turn will result in reduced total resistance (or increased electrical conductance) measured across the length of blade 117 (e.g., between the two contact pins 6022) in comparison to a new blade having the specified reference total resistance $R_{TOTAL\text{-}NEW}$. Base control unit circuitry 6021 compares the measured total resistance to the specified reference total resistance $R_{TOTALNEW}$ to determine the level of wear of the blade, which determined level of wear may be indicated by an output via notification unit 6003*b*.

In a fourth example, base module or unit 6020 can be used to make the conductance measurement via contact surface 602, which may be a conductive contact surface. A measurement of the electrical conductance across the length of blade 117 can be implemented by contacting the length of blade 117 with conductive contact surface 602. Base control unit circuitry 6021 compares the measured electrical conductance to a specified reference electrical conductance to determine the level of wear of the blade, which determined level of wear may be indicated by an output via notification unit 6003*b*.

FIG. 6*c* illustrates alternate embodiments of external devices that can be used instead of, or in conjunction with, base unit or module 6020. In one example, information from razor 1 (e.g., information output from sensor 6001 and proximity sensor 6002, and/or the information regarding the determined level of wear of the blade) can be transmitted, e.g., via a hard-wired connection through interface 6006*b* or wirelessly via transceiver 6007*b*, to a mobile device 6040, which may be provided with a processing unit and clients (e.g., one or more application software) that perform some or all of the functionalities performed by base unit or module 6020 shown in FIG. 6*b*, as well as additional functionalities, e.g., further analysis and/or added service such as automated ordering of replacement cartridges via the Internet. In another example, information from razor 1 (e.g., information output from sensor 6001 and proximity sensor 6002, and/or the information regarding the determined level of wear of the blade) can be transmitted, e.g., via a hard-wired connection through interface 6006*b* or wirelessly via transceiver 6007*b*, to a computer 6030, which may be provided with a processing unit and clients (e.g., one or more application software) that perform some or all of the functionalities performed by base unit or module 6020 shown in FIG. 6*b*, as well as additional functionalities, e.g., further analysis and/or added service such as automated ordering of replacement cartridges via the Internet. In another example, information and/or processing of information can be shared among razor 1, base unit or module 6020, computer 6030, and mobile device 6040.

Figure 7:
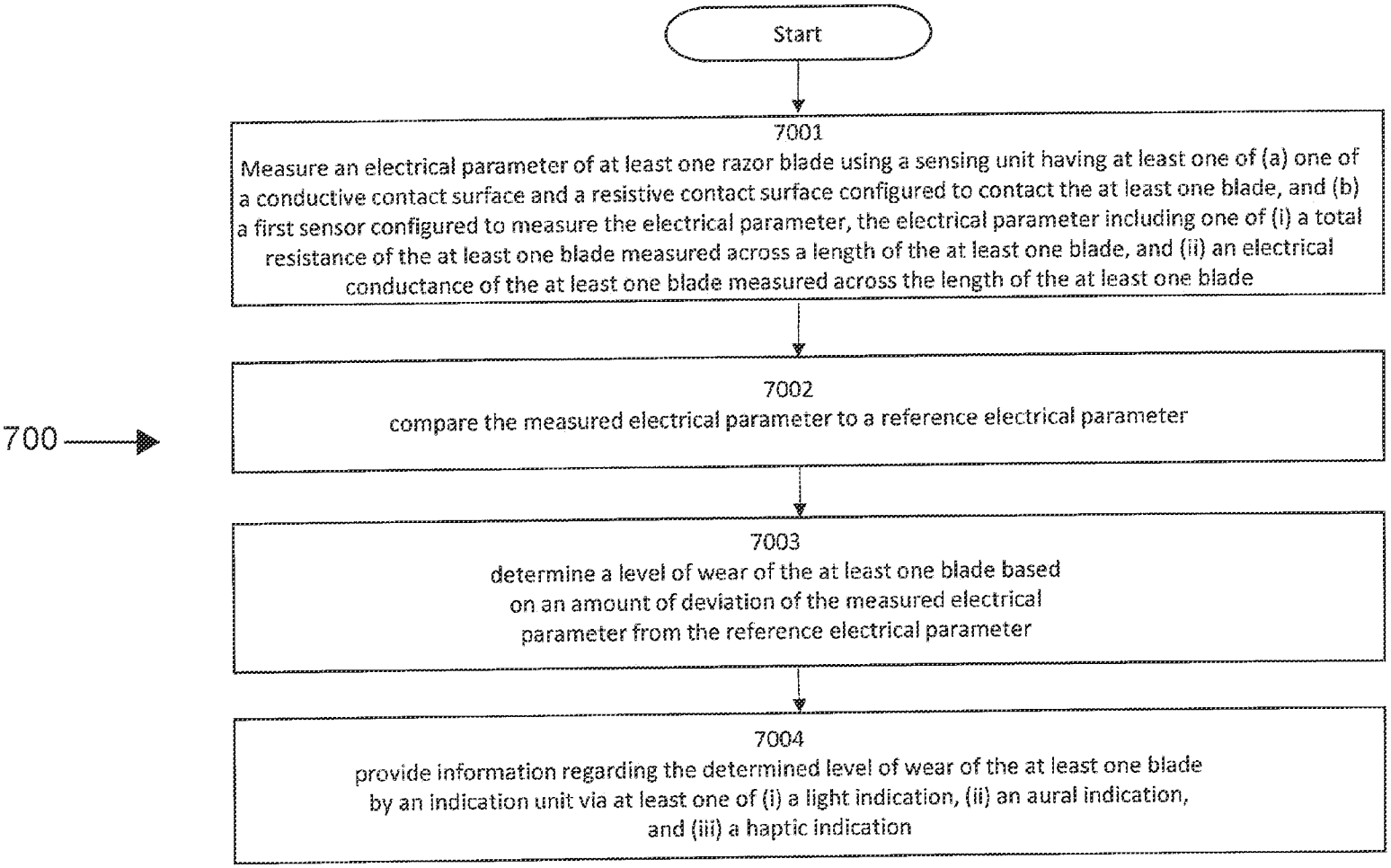
FIG. 7 is a flowchart illustrating a logic flow of a method for determining a level of wear of at least one blade of a razor according to an embodiment.

FIG. 7 illustrates a logic flow of another method for determining a level of wear of at least one blade of a razor according to an example embodiment. At block 7001, an electrical parameter of at least one razor blade is measured using a sensing unit having at least one of (a) one of a conductive contact surface and a resistive contact surface (e.g., 602) configured to contact the at least one blade 117, and (b) a first sensor (e.g., 6001) configured to measure the electrical parameter. The electrical parameter includes one of (i) a total resistance of the at least one blade measured across a length of the at least one blade, and (ii) an electrical conductance of the at least one blade measured across the length of the at least one blade. At block 7002, the measured electrical parameter, e.g., $R_{TOTAL}$, is compared to a reference electrical parameter. At block 7003, a level of wear of the at least one blade is determined based on an amount of deviation of the measured electrical parameter from the reference electrical parameter, e.g., $R_{TOTALNEW}$. At block 7004, information regarding the determined level of wear of the at least one blade is provided by an indication unit (e.g.,

6003*a*) via at least one of (i) a light indication, (ii) an aural indication, and (iii) a haptic indication.

Figure 8:
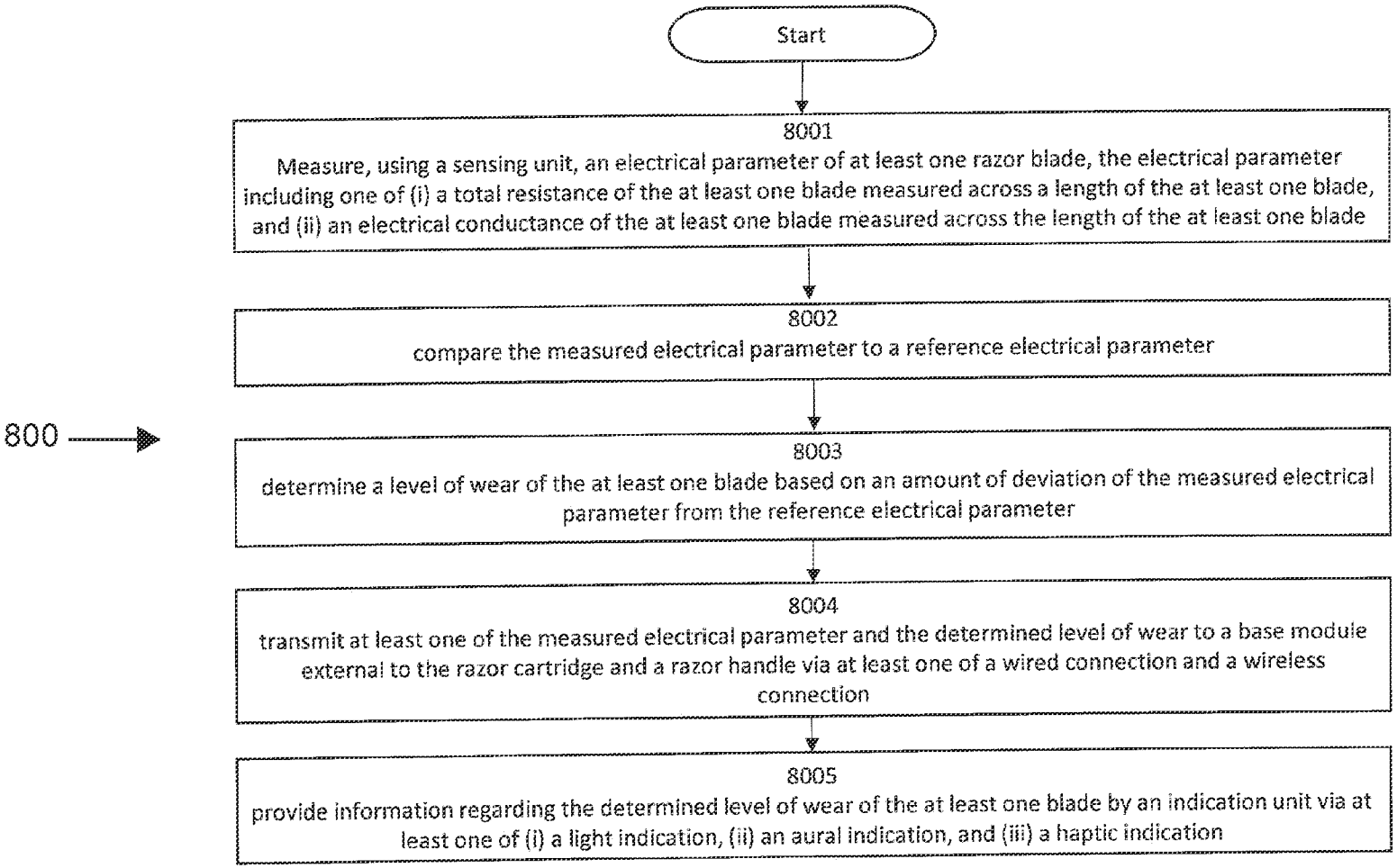
FIG. 8 is a flowchart illustrating a logic flow of another method for determining a level of wear of at least one blade of a razor according to another embodiment.

FIG. 8 illustrates a logic flow of another method for determining a level of wear of at least one blade of a razor according to an example embodiment. At block 8001, an electrical parameter of at least one razor blade 117 is measured using a sensing unit, e.g., 6001, the electrical parameter including one of (i) a total resistance of the at least one blade measured across a length of the at least one blade, and (ii) an electrical conductance of the at least one blade measured across the length of the at least one blade. At block 8002, the measured electrical parameter, e.g., $R_{TOTAL}$, is compared to a reference electrical parameter, e.g., $R_{TOTAL\text{-}NEW}$. At block 8003, a level of wear of the at least one blade is determined based on an amount of deviation of the measured electrical parameter from the reference electrical parameter. At block 8004, at least one of the measured electrical parameter and the determined level of wear is transmitted to a base module, e.g., 6020, external to the razor cartridge 100 and a razor handle 199 via at least one of a wired connection (e.g., via interface connection 6006*a*) and a wireless connection (e.g., via transceiver 6007*a*). At block 8005, information regarding the determined level of wear of the at least one blade is provided by an indication unit (e.g., 6003*a*) via at least one of (i) a light indication, (ii) an aural indication, and (iii) a haptic indication.

Figure 9:
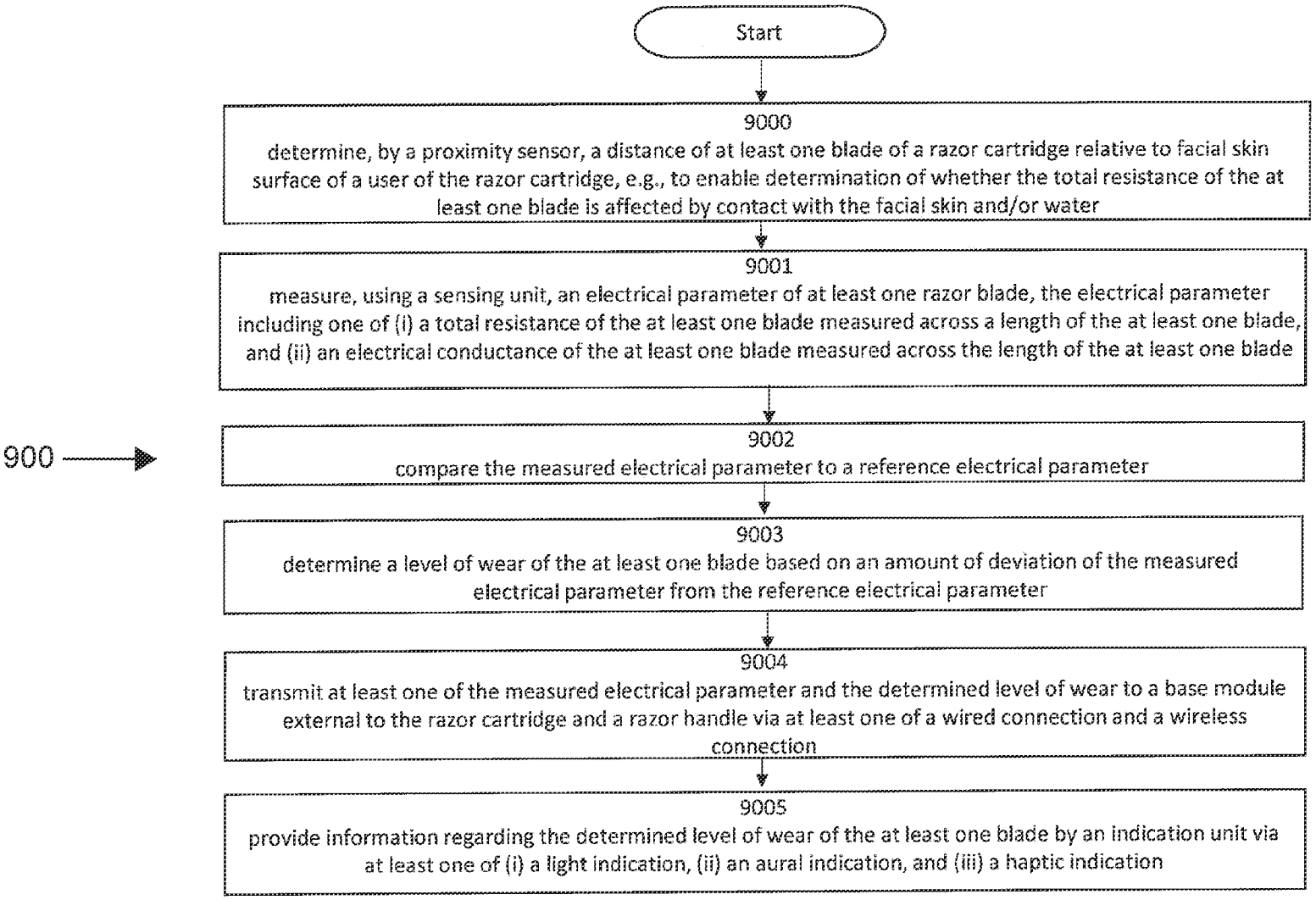
FIG. 9 is a flowchart illustrating a logic flow of yet another method for determining a level of wear of at least one blade of a razor according to yet another embodiment.

FIG. 9 illustrates a logic flow of another method for determining a level of wear of at least one blade of a razor according to an example embodiment. At block 9000, a proximity sensor, e.g., 6002, is used to determine a distance of at least one blade 117 of a razor cartridge 100 relative to facial and/or body skin surface of a user of the razor cartridge, e.g., to enable determination of whether the total resistance of the at least one blade is affected by contact with the facial and/or body skin and/or water. At block 9001, an electrical parameter of at least one razor blade 117 is measured using a sensing unit, e.g., 6001, the electrical parameter including one of (i) a total resistance of the at least one blade measured across a length of the at least one blade, and (ii) an electrical conductance of the at least one blade measured across the length of the at least one blade. At block 9002, the measured electrical parameter, e.g., $R_{TOTAL}$, is compared to a reference electrical parameter, e.g., $R_{TOTAL\text{-}NEW}$. At block 9003, a level of wear of the at least one blade is determined based on an amount of deviation of the measured electrical parameter from the reference electrical parameter. At block 9004, at least one of the measured electrical parameter and the determined level of wear is transmitted to a base module, e.g., 6020, external to the razor cartridge 100 and a razor handle 199 via at least one of a wired connection (e.g., via interface connection 6006*a*) and a wireless connection (e.g., via transceiver 6007*a*). At block 9005, information regarding the determined level of wear of the at least one blade is provided by an indication unit (e.g., 6003*a*) via at least one of (i) a light indication, (ii) an aural indication, and (iii) a haptic indication.

Figure 10:
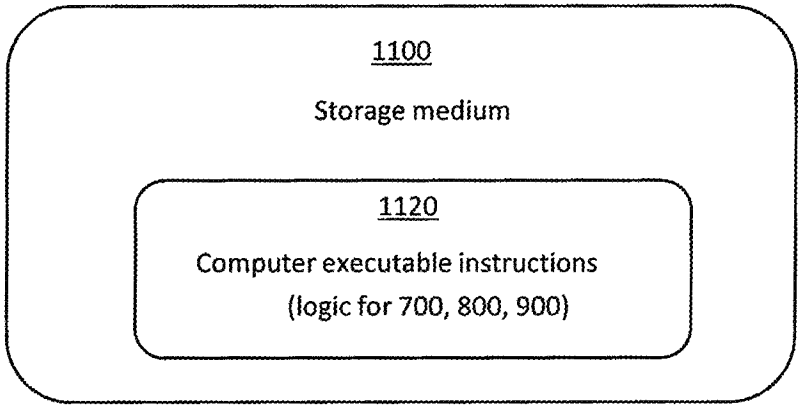
FIG. 10 illustrates a computer-readable storage medium according to an embodiment.

FIG. 10 illustrates an embodiment of a storage medium 1100, which may comprise an article of manufacture, e.g., storage medium 1100 can include any non-transitory computer readable medium or machine-readable medium, such as an optical, magnetic or semiconductor storage. Storage medium 1100 can store various types of computer executable instructions, e.g., 1120. For example, storage medium 2000 can store various types of computer executable instructions to implement techniques 700, 800, and 900. For example, storage medium 1100 can store various types of computer executable instructions to implement technique 700, 800, and 900, which instructions may be executed by, e.g., control unit 6004, base unit circuitry 6021, computer 6030 and/or mobile device 6040, to carry out the techniques described herein.

Some examples of a computer readable storage medium or machine-readable storage medium include tangible media capable of storing electronic data, e.g., volatile memory or non-volatile memory, removable or non-removable memory, erasable or non-erasable memory, writeable or re-writeable memory, and the like. Some examples of computer-executable instructions include suitable type of code, e.g., source code, compiled code, interpreted code, executable code, static code, dynamic code, object-oriented code, visual code, and the like. The examples are not limited in this context.

Figure 11:
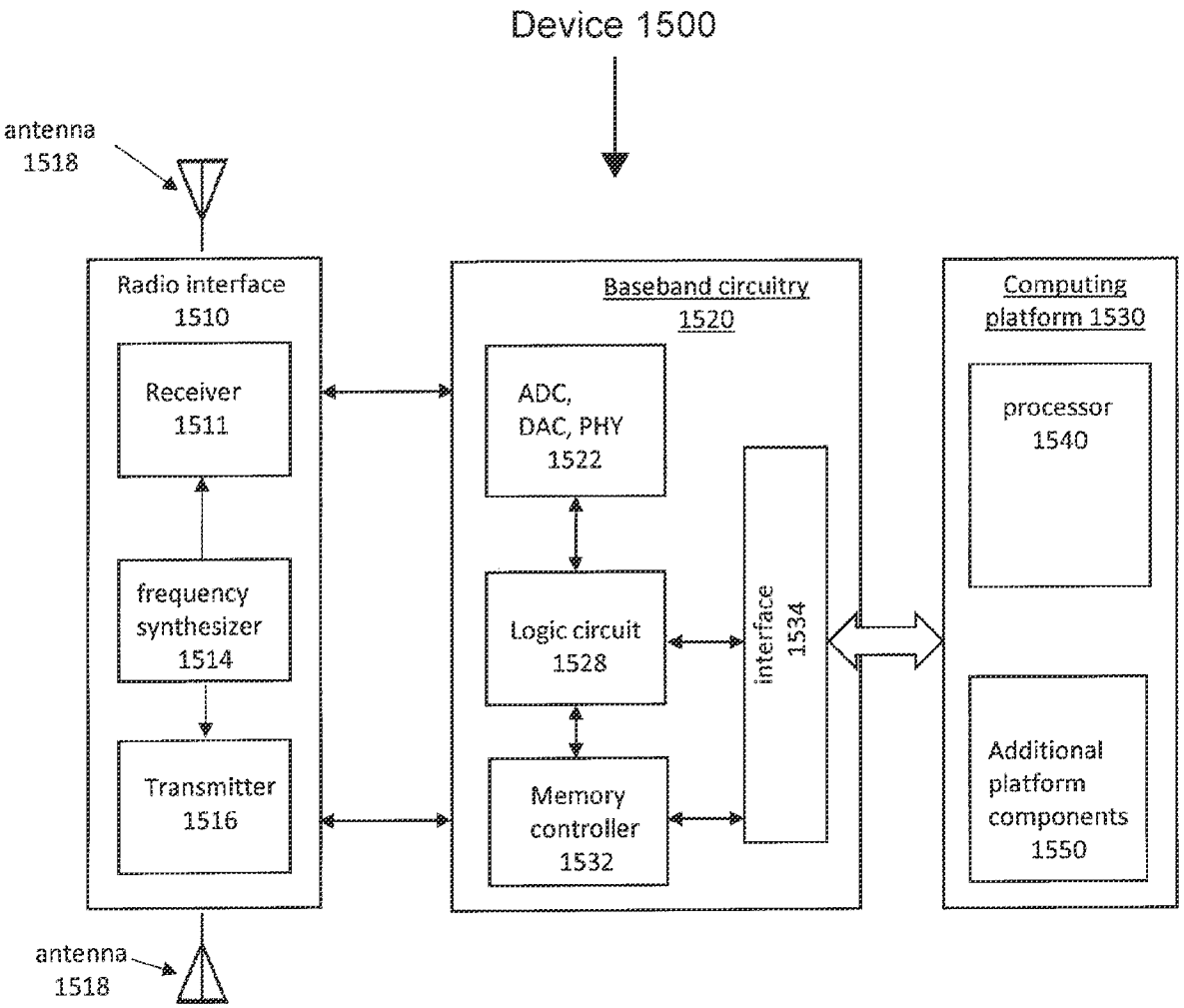
FIG. 11 illustrates an embodiment of a communication device for implementing one or more logic flows of the present disclosure.

FIG. 11 illustrates an embodiment of a communications device 1500 which may implement one or more of logic flow 700, logic flow 800, and logic flow 900, storage medium 1100, computer 6030, mobile device 6040, one or more functionalities of the circuitry of razor 1, and one or more functionalities of base unit 6020, according to one or more embodiments. In an exemplary embodiment, communication device 1500 comprises a logic circuit 1528 that can include physical circuits to perform operations described for one or more of logic flow 700, logic flow 800, and logic flow 900, for example. In addition, communication device 1500 can include a radio interface 1510, baseband circuitry 1520, and computing platform 1530. However, the embodiments are not limited to this example configuration.

Communication device 1500 can implement some or all of the structure and/or operations for one or more of logic flow 700, logic flow 800, and logic flow 900, storage medium 1100, computer 6030, mobile device 6040, one or more functionalities of the circuitry of razor 1, one or more functionalities of base unit 6020, and logic circuit 1528 (i) in a single computing entity, e.g., a single device, or (ii) in a distributed manner. In the latter case, communication device 1500 can distribute portions of the structure and/or operations for one or more of logic flow 700, logic flow 800, and logic flow 900, storage medium 1100, computer 6030, mobile device 6040, one or more functionalities of base unit 6020, and logic circuit 1528 across multiple computing platforms and/or entities using a distributed system architecture, e.g., a master-slave architecture, a client-server architecture, a peer-to-peer architecture, a shared database architecture, and the like. The embodiments are not limited in this context.

In an example embodiment, radio interface 1510 includes one or more component(s) adapted to transmit and/or receive single-carrier or multi-carrier modulated signals such as CCK (complementary code keying), OFDM (orthogonal frequency division multiplexing), and/or SC-FDMA (single-carrier frequency division multiple access) symbols. Radio interface 1510 may include, e.g., a receiver 1511, a frequency synthesizer 1514, a transmitter 1516, and one or more antennas 1518. However, the embodiments are not limited to these examples.

Baseband circuitry 1520, which communicates with radio interface 1510 to process receive signals and/or transmit signals, can include a unit 1522 comprising an analog-to-digital converter, a digital-to-analog converter, and a baseband or physical layer (PHY) processing circuit for physical link layer processing of receive/transmit signals. Baseband circuitry 1520 can also include, for example, a memory controller 1532 for communicating with a computing platform 1530 via an interface 1534.

The computing platform 1530, which can provide computing functionality for device 1500, can include a processor 1540 and other platform components 1750, e.g., processors, memory units, chipsets, controllers, peripherals, interfaces, input/output (I/O) components, power supplies, and the like.

Device 1500 can be, e.g., a mobile device, a smart phone, a fixed device, a machine-to-machine device, a personal digital assistant (PDA), a mobile computing device, a user equipment, a computer, a network appliance, a web appliance, consumer electronics, programmable consumer electronics, game devices, television, digital television, set top box, wireless access point, base station, subscriber station, mobile subscriber center, radio network controller, router, hub, gateway, and the like. These examples are not limiting.

Figure 12:
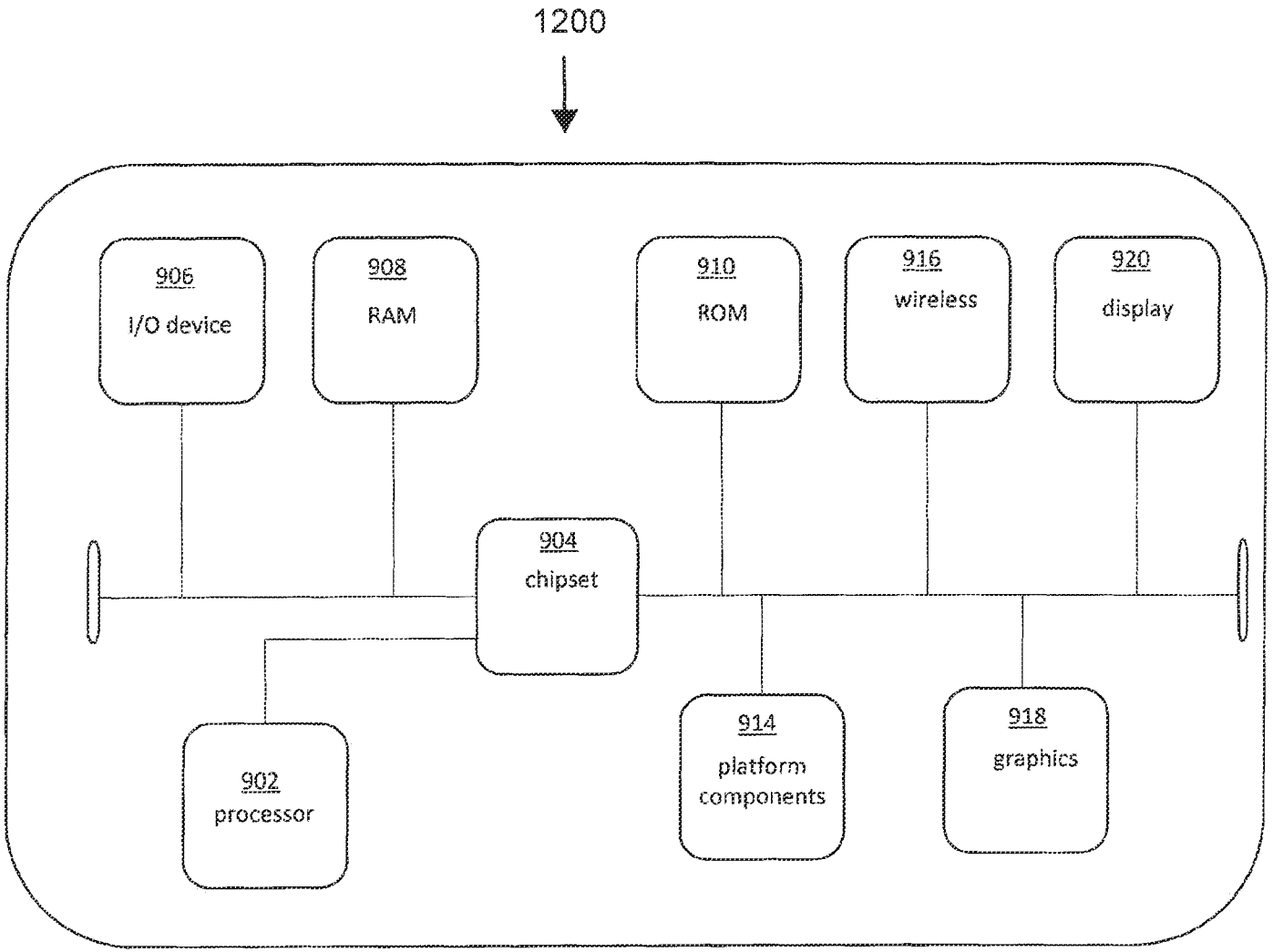
FIG. 12 illustrates an embodiment of a system of the present disclosure.

FIG. 12 is a diagram of an exemplary system embodiment configured as a platform 1200, which includes, e.g., a processor 902, a chipset 904, an I/O (input/output) device 906, a RAM (random access memory) 908, e.g., DRAM (dynamic RAM), and a ROM (read only memory) 910, a wireless communications chip 916, a graphics device 918, and display 920, and other platform components 914 (e.g., a cooling system, a heat sink, vents, and the like), which are coupled to one another by way of a bus 312 and chipset 904. The examples are not limiting.

The techniques described herein are exemplary, and should not be construed as implying any specific limitation on the present disclosure. It should be understood that various alternatives, combinations and modifications could be devised by those skilled in the art. For example, steps associated with the processes described herein can be performed in any order, unless otherwise specified or dictated by the steps themselves. The present disclosure is intended to embrace all such alternatives, modifications and variances that fall within the scope of the appended claims.

The terms "comprises" or "comprising" are to be interpreted as specifying the presence of the stated features, integers, steps or components, but not precluding the presence of one or more other features, integers, steps or components or groups thereof. The terms "a" and "an" are indefinite articles, and as such, do not preclude embodiments having pluralities of articles.

Some embodiments can be described using the expression "one embodiment" or "an embodiment" along with their derivatives. These terms mean that a particular feature, structure, or characteristic described in connection with the embodiment is included in at least one embodiment. The appearances of the phrase "in one embodiment" in various places in the specification are not necessarily all referring to the same embodiment.

The invention claimed is:

1. A system comprising:

a cartridge having at least one blade; and a sensing unit configured to measure an electrical parameter of the cartridge having the at least one blade, the electrical parameter includes one of (i) a total resistance of the cartridge having the at least one blade measured across a length of the at least one blade, (ii) a resistance of the at least one blade measured across the length of the at least one blade, (iii) a total electrical conductance of the cartridge having the at least one blade measured across the length of the at least one blade and (iv) a conductance of the at least one blade measured across the length of the at least one blade; and a processing unit configured to:

(i) compare the electrical parameter to a reference electrical parameter; and (ii) determine a level of wear of the cartridge having the at least one blade based on an amount of deviation of the electrical parameter from the reference electrical parameter.

2. The system according to claim 1, wherein:

(a) the at least one blade includes a substrate, a conductive layer provided on the substrate, and an outer layer provided on the conductive layer; and (b) the reference electrical parameter includes one of (i) a specified reference total resistance measured across the length of the at least one blade, and (ii) a specified reference electrical conductance of the at least one blade measured across the length of the at least one blade.

3. The system according to claim 2, wherein the sensing unit includes a first sensor configured to measure the electrical parameter and provided in or on one of the razor cartridge and a razor handle.

4. The system according to claim 3, wherein at least one of (i) the at least one blade is configured to be electrically coupled to a base module external to both the cartridge and the razor handle, and (ii) the electrical parameter is at least one of transmitted to and stored in the base module.

5. The system according to claim 3, wherein at least one of the electrical parameter and the level of wear is transmitted to a base module, wherein the base module is external to the cartridge or the razor handle, and wherein the transmission is via at least one of a wired connection and a wireless connection.

6. The system according to claim 2, further comprising:

a proximity sensor configured to determine a distance of the at least one blade of the cartridge relative to a facial and/or body skin surface of a user of the cartridge.

7. The system according to claim 2, further comprising:

a notification unit configured to output information regarding the level of wear of the at least one blade.

8. The system according to claim 2, wherein the sensing unit includes (i) a resistive contact surface configured to contact the at least one blade, and (ii) a first sensor configured to measure the electrical parameter.

9. The system according to claim 8, wherein the sensing unit is provided in a base module external to both the cartridge and a razor handle.

10. The system according to claim 8, further comprising:

a notification unit including a light indication unit configured to output information regarding the level of wear of the at least one blade.

11. The system according to claim 2, wherein the sensing unit includes a conductive contact surface configured to contact the at least one blade.

12. The system according to claim 11, wherein the sensing unit is provided in a base module external to both the cartridge and a razor handle.

13. A method comprising:

measuring an electrical parameter of a razor cartridge having at least one blade, wherein the electrical parameter includes one of (i) a total resistance of the at least one blade measured across a length of the at least one blade, and (ii) an electrical conductance of the at least one blade measured across the length of the at least one blade;

comparing the electrical parameter to a reference electrical parameter; and determining a level of wear of the at least one blade based on an amount of deviation of the electrical parameter from the reference electrical parameter.

14. The method of claim 13, wherein:

(a) the at least one blade includes a substrate, a conductive layer on the substrate, and an outer layer on the conductive layer; and (b) the reference electrical parameter includes one of (i) a specified reference total resistance measured across the length of the at least one blade, and (ii) a specified reference electrical conductance of the at least one blade measured across the length of the at least one blade.

15. The method of claim 14, wherein the measuring of the electrical parameter includes sensing by using a sensing unit, the sensing unit including (i) a resistive contact surface configured to contact the at least one blade, and (ii) a first sensor configured to measure the electrical parameter.

16. The method of claim 15, further including providing the sensing unit in a base module external to both the razor cartridge and a razor handle.

17. The method of claim 13, wherein the measuring of the electrical parameter includes sensing by using a sensing unit, wherein the sensing unit includes a first sensor configured to measure the electrical parameter, and wherein the first sensor is provided in or on one of the razor cartridge and a razor handle.

18. The method of claim 17, further including transmitting at least one of the electrical parameter and the level of wear to a base module, wherein the base module is external to the razor cartridge and the razor handle, and wherein the transmission is via at least one of a wired connection and a wireless connection.

19. The method of claim 13, further comprising:

providing information regarding the level of wear of the at least one blade by at least one of (i) a light indication, (ii) an aural indication, and (iii) a haptic indication.

20. The method of claim 13, further comprising:

determining, by a proximity sensor, a distance of the at least one blade of the cartridge relative to a facial and/or body skin surface of a user of the razor cartridge.

* * * * *